US008046304B2

(12) United States Patent
Bleumer

(10) Patent No.: US 8,046,304 B2
(45) Date of Patent: Oct. 25, 2011

(54) FRANKING METHOD AND MAIL TRANSPORT SYSTEM WITH CENTRAL POSTAGE ACCOUNTING

(75) Inventor: Gerrit Bleumer, Schildow (DE)

(73) Assignee: Francotyp-Postalia GmbH (DE)

( * ) Notice: Subject to any disclaimer, the term of this patent is extended or adjusted under 35 U.S.C. 154(b) by 343 days.

(21) Appl. No.: 12/238,747

(22) Filed: Sep. 26, 2008

(65) Prior Publication Data

US 2009/0119219 A1 May 7, 2009

(30) Foreign Application Priority Data

Nov. 2, 2007 (DE) ..... 10 2007 052 458

(51) Int. Cl.
*H04K 1/00* (2006.01)

(52) U.S. Cl. ..... 705/62; 705/60; 705/408

(58) Field of Classification Search ..... 705/60, 705/62

See application file for complete search history.

(56) References Cited

U.S. PATENT DOCUMENTS

| | | | | |
|---|---|---|---|---|
| 4,873,645 | A | 10/1989 | Hunter et al. | |
| 5,612,889 | A | 3/1997 | Pintsov et al. | |
| 5,982,896 | A * | 11/1999 | Cordery et al. | 705/62 |
| 6,041,704 | A * | 3/2000 | Pauschinger | 101/91 |
| 6,233,565 | B1 * | 5/2001 | Lewis et al. | 705/35 |
| 6,233,568 | B1 * | 5/2001 | Kara | 705/410 |
| 6,456,987 | B1 | 9/2002 | Pauschinger | |
| 6,775,656 | B1 | 8/2004 | Gettwart et al. | |
| 6,801,833 | B2 | 10/2004 | Pintsov et al. | |
| 6,847,951 | B1 * | 1/2005 | Cordery et al. | 705/60 |
| 6,868,407 | B1 | 3/2005 | Pierce | |
| 6,934,839 | B1 * | 8/2005 | Pagel | 713/156 |
| 6,938,016 | B1 * | 8/2005 | Ryan, Jr. | 705/60 |
| 6,944,770 | B2 | 9/2005 | Henderson et al. | |
| 7,069,253 | B2 | 6/2006 | Leon | |
| 7,110,576 | B2 | 9/2006 | Norris, Jr. et al. | |
| 7,219,084 | B1 | 5/2007 | Gettwart et al. | |
| 7,225,166 | B2 * | 5/2007 | Brookner et al. | 705/62 |
| 7,243,842 | B1 * | 7/2007 | Leon et al. | 235/381 |
| 7,613,639 | B1 * | 11/2009 | Ogg | 705/35 |
| 2005/0209875 | A1 | 9/2005 | Bleumer et al. | |
| 2006/0002550 | A1 * | 1/2006 | Campagna et al. | 380/46 |
| 2006/0069655 | A1 * | 3/2006 | Athens et al. | 705/67 |
| 2006/0190732 | A1 * | 8/2006 | Fery et al. | 713/176 |

FOREIGN PATENT DOCUMENTS

| | | |
|---|---|---|
| DE | 38 40 041 | 6/1990 |
| DE | 100 23 145 | 11/2001 |
| EP | 0 862 145 | 9/1998 |
| EP | 0 735 719 | 6/2003 |
| EP | 0 735 721 | 10/2006 |
| GB | 2 193 468 | 2/1988 |

* cited by examiner

*Primary Examiner* — Andrew J. Fischer
*Assistant Examiner* — C. Aaron McIntyre
(74) *Attorney, Agent, or Firm* — Schiff Hardin LLP

(57) ABSTRACT

In a franking method and a mail transport system, a franking image is calculated before generation thereof on a mail piece. The franking image includes a franking image key, and for each new franking image, the franking image key therefor is derived from a predecessor franking image key according to a first crypto-algorithm. An integrity check code is also generated based on the new franking image key, a key generation number, an apparatus identifier of the franking device, and a second crypto-algorithm. The franking image includes at least the device identifier, the key generation number and the integrity check code. Upon transport of the mail piece to a sorting center, the franking image is scanned and fees for billing are generated based thereon.

18 Claims, 8 Drawing Sheets

FRANKING METHOD AND MAIL TRANSPORT SYSTEM WITH CENTRAL POSTAGE ACCOUNTING

BACKGROUND OF THE INVENTION

1. Field of the Invention

The present invention concerns a franking method and mail transport system with central postage accounting. The mail transport system is of the type having a data center of the postal carrier, a data center of an operator and at least one franking device. The postal carrier transports the mail pieces franked by the franking device to the mail sorting center. The purpose of the invention is to achieve a secure mail transport system with franking devices of simple design.

2. Description of the Prior Art

A simple solution that assumes either a personal computer (PC) with printer at the sender or a special franking device that is very simple to operate but that thereby requires neither an online connection for every franking nor a security module has previously been missing. Such an offline solution without security module is possible if the mail carrier conducts the postage determination and billing in the framework of its service provision. This means that a suitable software collects the required postage for the posting while the postings are read in the mail sorting center of the mail carrier and the destination address is determined. The software transmits a data set composed of sender and postage amount to the customer account administration of the mail carrier, which bills a customer account of the sender. The billing with the customer (sender) can ensue temporally decoupled from the accounting entry.

This method is called "central postage accounting" because the required postage values are centrally collected in the mail sorting centers of the mail carrier and not, as in the conventional, "decentralized postage accounting", from the senders before commission to post offices or mail boxes.

Known from DE 38 40 041 A1 is an arrangement for franking of postal items with a franking device that prints a value imprint that is accounted by a computer of a central calculation point. This known franking device has a memory whose content is increased with each franking process and whose content can be read out by the user of the franking device. After a cover check, the computer is connected with a giro computer of the postal authority to bill the value imprint. The postal authority runs a mail giro account of the owner of the franking device. The giro computer releases every single value imprint after cover check and billing.

This means that the required postage for the posting is determined and paid before the postings are transported to the mail sorting center of the letter carrier and are read there along with the destination address. No retroactive payment of the service provided is provided in this mail transport system with central postage accounting.

In order to achieve the greatest possible security with regard to the postage accounting both for the mail carrier and for the user, the content of the memory (fashioned as units and sum memory) can be read out only by the user and by the computer of the charging location, and the connection of the computer of the charging location with the franking device is fashioned as a dedicated line (TEMEX) that is always in operation.

For small SOHOs (Small Office Home Office), no truly appropriate electronic franking solutions are yet on the market.

There are online solutions that assume a PC with printer at the sender and establish a data connection to the postage provider with every franking.

Furthermore, there are offline solutions that assume special franking devices with security module in which pre-paid postage values are administered in a manipulation-safe manner (Gerrit Bleumer: Electronic Postage Systems; Springer-Verlag, New York, 2007, Chapter 4.1 Basic Cryptographic Mechanisms, Page 91).

In postal markets worldwide it has been widespread to collect the postage fees decentrally at the input of the postal transport channel, for example via stamp sales or adoption of DV-cleared mailings in post offices and postal agents, via franking machines or franking service stations. For the sender, postage fees are due when the corresponding postage stamps are ordered or delivered, for example in the form of stamps, DV imprints and delivery lists, franking imprints in franking machines and PC franking solutions and franking services, etc.

To the extent that mail carriers transition to registering the processed mail entirely automatically for the purposes of address detection and additional services such as shipment tracking, the possibility results to also collect the due postage fees only upon processing in the mail sorting center. In this accounting model, customers do not have to pay any postage in advance; rather, they receive an invoice for their transported mailings at the end of the month, for example. If necessary, individual transport documentation can be ordered, similar to what is typical today for telecommunication invoices.

In the case of franking machines, this accounting model means that credit downloads are no longer necessary, rather the franking machine serves only to register the desired postal product and calculate and apply a corresponding franking imprint.

This accounting model is called "central postage accounting" in contrast to the previously typical "decentralized postage accounting". Central postage accounting leads to a delayed payment request to the sender. Nevertheless, the designation "postpay" or "pay later" is not characteristic because in conventional, decentralized postage accounting the effective charging of the customer account can also in fact ensue later (for example via debiting methods or credit card payment) than the postal service is provided.

A system and a method for authentication of a mail sender who signs a mailing are known from U.S. Pat. No. 7,110,576. A handwritten signature represents a biometric identity of the sender which the sender applies to a mailing in that he performs a handwritten signature with the aid of a digitizer pen. A mail carrier subsequently scans the signature and can check from a central remote service whether the read signature is valid. The digitizer pen has also originally been registered at the remote service by means of signature tests. In a special design, the digitizer pen writes information into a radio frequency identity device (RFID), wherein the RFID tag is attached to the mailing. As a result of the check of the biometric feature for sufficient similarity of a biometric reference feature performed by the asserted sender, the mail carrier receives a response and attaches the result to the mailing insofar as said result is positive. A biometric sender recognition disadvantageously does not allow a unique device detection. No integrity checksum about the sender recognition is provided whatsoever. Moreover, it would be complicated to ensure that particular technical features such as, for example, an RFID tag are present in the mailing.

A system for identification of mailings by means of RFID is known from U.S. Pat. No. 6,801,833 B2. The mailings are bundled into stacks that are in turn combined in containers that are themselves transported in delivery trucks. Each container is equipped with its own RFID tag that lists all contained containers or mailings, such that every container and every mail piece can be automatically detected and tracked by a central computer at defined points of the mail transport path. The RFID tag can carry the following information features: addressee, sender, shipment ID, integrity checksum of a shipment ID, shipment value or encrypted shipment value. It thereby results that mailings are marked with unique sender identifiers, but in a different form and together with different features than those of the present invention. The sender can deliver a larger quantity of mailings in that he simultaneously provides one delivery list (mailing manifest). In manifest mailing systems, the sender does not determine the required postage amount, rather the delivery post office does this based on the mailing manifest. Therefore only one feature that produces a reference to the associated mailing manifest (permit imprint) must be applied to the individual mailings. In an atypical manner, an RFID tag is provided for this. A mailing ID uniquely identifies the mail piece, wherein the mailing ID can consist of the following parts: sender account number, date, tray ID, piece ID in mail tray, e-mail address of the sender, shipment value, shipment category and mail carrier. An error correction code (CRC) or a digital signature or a message authentication code (MAC) can be used for the identifiers of the mailings and all containers. The integrity checks should prevent that mailings are added to a wrong mail tray or are associated with an incorrect mail tray of an incorrect palette etc. due to technical errors (error correction code) or fraudulent manipulation (digital signature or message authentication code). Therefore an RFID tag must be applied to the individual mailings; however, given the number of senders it is difficult to ensure that the same conditions prevail for all. This is hardly possible when the sender attaches the RFID tag to the mail piece. A wrong adhesive can lead to the signal that an RFID tag detaches. For the sender it is not possible without further measures to read information from the RFID tag. A use of special devices at the sender would be necessary in order to store this information in the RFID tag.

A mail processing system with unique mail piece authorization that is assigned before the entrance of a mail piece into the processing flow of a mail transport service is known from U.S. Pat. No. 5,612,889. A unique shipment ID that serves as an index in a mailing manifest that contains the service address of all committed mailings is stamped on mailings. An address correction of the basis of the mailing manifests is thereby enabled. A commission of mailings is electronically recorded in advance at the mail carrier. For this the sender generates an electronic mailing manifest that he transmits to the mail carrier with cryptographic security. The letter carrier evaluates the information about the expected mailings and their addresses for service, corrects addresses if necessary and determines the required postage fees and subsequently bills the sender. The mail carrier returns a list of shipment IDs to the sender, who prints these on his mailings. The sender subsequently commits his mailings to the letter carrier. The mailing manifest is already present at the mail carrier at this point in time. The shipment ID alone does not designate a sender; rather, it is merely an index in a mailing manifest. This shipment ID only receives a meaning in connection with the mailing manifest. However, the shipment ID is not a unique identifier that can be used on all of the mailings of a franking device and can identify the sender.

From EP 710 930 B1, corresponding to U.S. Pat. No. 5,612,889, it is known to use a unique shipment ID that serves as an index in a mailing manifest that contains the addresses of service or destination ZIP codes of all committed mailings is imprinted on the mailings.

A method for mail good processing and a mail good processing system with hierarchical mail good processing is known from EP 1 058 212 A1, corresponding to U.S. Pat. No. 7,219,084. Private mail carriers that are regionally established relay mailings to super-regional mail carriers for their distribution outside of their region of operation. An identification of the sender ensues by means of a chip card that the customer of the private mail carrier bears and inserts into a card reader of the mail infeed system (mail box) when the customer surrenders the mail. It is provided that the customer receives a receipt for the mail placed in a mail box and initially to be supplied to a first carrier/location. The chip card serves as a customer card that already exhibits an identification number. Each mail good is provided with a machine-readable marking that consists of a number and additional shipping data specific to each mail good. The first carrier transports the mail from the mail infeed station (mail box) to the first location and there franks the letter with a franking imprint and conducts a debit from the customer account at a customer bank and commits the franked letter to a mail distribution center of a second carrier, which transports the mail further. A conventional franking is thus implemented and a conventional mailing manifest is generated after the marking of the mail good. The due postage amount is determined and collected while the mail goods are committed. The corresponding markings are applied to the mail goods in the same process. The marking can contain date and time of the commission and moreover an identification of the customer that has previously been imported from his customer card into the infeed station. This method can be designated as a "semi-central postage accounting". Security checks in addition to the shipment identification and sender identification are not described.

Given decentralized postage accounting, pre-paid electronic money or credit is loaded into the franking device. If manipulation of these funds amount occurs, unpaid postal service can be accessed as a result. This can be difficult to detect by the harmed mail carrier and even more difficult to track back to the individual fraudulent party. The required expenditure via a hardware security module or an online data connection for franking which should prevent the fraudulent manipulations is disadvantageous.

SUMMARY OF THE INVENTION

An object of the present invention is to avoid these disadvantages and to provide a franking method and mail transport system with central postage accounting, wherein the security of the system is nevertheless guaranteed with the use of franking devices that are of simple design and user-friendly. The franking device should apply a manipulation-safe device identifier to the mail good.

Starting from the realization that a trust model is required that is different than in decentralized postage accounting, the security of the billing for franking devices is increased in spite of their simplified design. Centrally stored data can be better protected from falsification. Given central postage accounting, each franking device uses an individual device identifier that is embedded in all its franking imprints. Given registration of each franking device, the mail carrier associates its device identifier with an electronic device account which it later associates with all postage fees for mailings that bear the corresponding device identifier. The accounting with the customer can be conducted temporally decoupled from the billing. The bank account of the sender is advantageously correspondingly charged at the end of each accounting period with the accrued costs of an electronic device account.

The central postage accounting enables franking solutions at the sender that can function securely offline and without a security module. However, the mailings must carry a falsification-safe identifier of the sender or the sender's franking device so that the postage costs can be correctly associated with the originating senders. This is achieved by a symmetric encryption of parameters and with a key that changes with every franking imprint and which can be kept synchronous in the carrier data center without a communication between the franking device and the carrier data center being required with every franking. Rather, an initial initialization of the franking device is sufficient.

A secret first franking image key is thereby transmitted encrypted from the franking device to the mail carrier data center via the operator data center. The first franking image key can be encrypted in the franking device by means of a private communication key and decrypted in the operator data center by means of a public communication key. The secret first franking image key can be transmitted on encrypted to the mail carrier data center in essentially the same manner. The latter therefore possesses a currently valid first franking image verification key which is stored associated with the sender or his device identifier. A marking on a mail piece or a franking image contains at least one device identifier of the franking device, one key generation number and an integrity check code. The latter allows a check of the integrity of such parameters as device identifier and key generation number because the latter are encrypted by means of the currently valid first franking image key for the integrity check code. The device identifier of the franking device, the key generation number and the first franking image key are transmitted to the data center of the mail carrier during the initialization of the franking device.

After a franking, a currently valid second franking image key is generated in the franking device from the first or, respectively, previously valid franking image key, which second franking image key corresponds to a currently valid second franking image verification key that is, however, generated on the mail carrier side. The local key generation number in a franking device and its local copy on the mail carrier side are kept in sync in order to be able to derive the currently valid franking image verification key at the mail carrier from the previous valid franking image verification key.

Every device identifier is uniquely associated with a customer account to which the spent postage fees are billed at the end of every accounting period. After every franking, the key generation number in the franking device is changed, wherein a step-by-step alteration of the key generation number by an established numerical value ensues. For example, the key generation number is increased by one. A next valid cryptographic key is then derived from the current valid cryptographic key according to a first algorithm.

The franking image is equipped with an electronic module for secure administration of a postal identity and, for better differentiation from the conventional franking machines, is subsequently called a Postal Identity Management Device (PIMD).

Advantageously, pre-paid electronic money or electronic credit must no longer be loaded into the franking devices. There is therefore no possibility to manipulate pre-paid electronic money quantities. There is also no possibility to defraud the mail carrier by copying imprints. There is no inducement at all for a sender to manipulate his own franking device. Therefore, from the viewpoint of the mail carrier there is also no need to protect franking devices from intrusions of their users, which is why there is also no need for a hardware security module in franking devices. There is just as little need to establish an online connection before or during the franking except in an initialization of the PIMD.

However, in principle there is the possibility for each sender to use an invalid or incorrect device identifier (device ID). If a sender manages to misappropriate a foreign device identifier, the sender could send mail at the cost of the misappropriated device identifier.

However, invalid device identities are in principle recognizable by the mail sorting center when they are evaluated online, i.e. in the mail sorting. In principle, merely incorrect device identifiers cannot be detected by the mail sorting center since the true identity of the sender is not known. Although this could be detected via a biometric detection of the consigner at the mail box, the franking device would then not be simply designed. The use of incorrect device identifiers is therefore not detectable without additional measures in the consignment process, and consequently the potential for fraud here is relatively large. However, a fraudulent manipulation of the device identifier can be made significantly more difficult by a combination of the following measures:

a) Protection from misuse of the identification of the sender franking device by means of password input via keyboard or, alternatively, by means of RFID identification, magnetic card, chip card, mobile device (cell phone, PDA) connected via personal network (Bluetooth, USB etc.) on the franking device side.
b) Authentication of the device identifier in every franking imprint on the mail carrier side in order to exclude the use of incorrect device identifiers.
c) One-time authentication of the device identifier in each franking imprint on the mail carrier side in order to exclude the reuse of copied authentications of incorrect device identifiers. It is provided that every cryptographic franking image key is used for at most one franking image which contains scannable information such as the device identifier of the franking device, the key generation number and the integrity check code.
d) Secure the communication connection, at least to the operator data center, via encryption.
e) In multi-user franking devices (for example PC frankers), the different users of a franking device must be protected from one another. This can be achieved given use of a PC with the use of known operating systems that can administer separate user accounts.

Since the first key generation number is transmitted together with the first franking image key and the device identifier to a data center of the mail carrier, a remote scanning and evaluation of franking images to be checked (which franking images have been applied to the mail pieces by the franking device) can ensue there.

An integrity verification code is generated according to a second crypto-algorithm by means of the secret cryptographic franking image key of the franking device of the sender, the device identifier of the franking device and the current key generation number, wherein the franking image contains (in scannable form) at least the device identifier of the franking device, the current key generation number and the integrity verification code.

In the data center, a derivation of the franking image verification key that corresponds to the next secret franking image key can ensue according to a first crypto-algorithm from the first franking image key and from the current key generation number (scannable in the franking image) transmitted by every further mail piece if, for every franking image, a new franking image key was derived from a predecessor of the franking image key according to the same first crypto-algorithm.

An evaluation of the scanned data by means of a verification process in the data center of the mail carrier includes a determination of the mathematical relationship of the scanned key generation numbers to the copy of the last used key generation number. The value of the variation relative to the copy of the last used key generation number results from the product of every single step value with the number of variations. Given a step-by-step variation of the key generation number by an established numerical value in preparation of a subsequent franking image key, the aforementioned mathematical relationship results from the number of variations. A franking image verification key is calculated according to the first crypto-algorithm, wherein the first crypto-algorithm is applied as often as is predetermined by the mathematical relationship. The mail piece subjected to a winnowing and the scanned data are subjected to an error correction if a step-by-step variation of the key generation number by an established numerical value does not lead to the expected result, i.e. if the mathematical relationship does not correspond to the predetermined mathematical relationship. For example, this is case when the established mathematical relationship does not result from the number of variations. If a synchronization between the franking device and the data center (i.e. both between the scanned key generation number and its calculated copy and between the secret cryptographic franking image key and the calculated franking image verification key) is established in the aforementioned manner, a comparison integrity verification code can be calculated in the data center in order to cryptographically verify the scanned integrity verification code. A central postage accounting is implemented in the data center of the mail carrier when the authenticity of the integrity verification code demonstrably exists.

A mail transport system with central postage accounting includes a mail sorting center and data center of a mail carrier, a data center of an operator and a plurality of franking devices. The mail carrier transports the mail pieces franked by the franking device to the mail sorting center in a typical manner. Each franking device is engaged in a communication connection via a network and, if necessary, is in contact via a communication connection with the operator data center that registers the device identifier with its user and offers additional services. Each franking device can print franking imprints on letters and envelopes for mail pieces that are subsequently committed to the mail sorting center for further mail transport, which mail sorting center is connected in communication with the data center of the mail carrier. The data center of the mail sorting center is connected via a communication connection with the network and can likewise communicate with the operator data center as, conversely, the operator data center can communicate with the mail sorting center data center. As a result of an initialization of a franking device, information can thus arrive from the franking device via the operator data center to the data center of the mail carrier although the franking device enters into no direct communication with the data center of the mail carrier. With the aforementioned information, the data center of the mail carrier is able to evaluate information of the franking image, in particular to read and associate the device identifier with a sender and to invoice the postage fees for mail pieces of the same sender to a separate account, or for error correction.

The franking device can contain a key generator that generates a new franking image key for every next franking image.

Furthermore, a communication unit is provided in order to establish synchronization between franking device and data center as needed via the communication connection.

A scanner in the mail sorting center and a first means for evaluation in the data center of a mail carrier are provided that are in communication with one another, wherein the sender of the mail piece is determined via an association of the device identifier with a sender (which is stored in a database) via the first evaluation means, and the postage fee is determined via postage calculation means.

The evaluation unit in the data center includes a second means for security verification of every scanned franking image. The evaluation unit calculates a comparison integrity check code in the data center in order to cryptographically verify the scanned integrity check code if synchronization can be established between the scanned key generation number and its calculated copy and between the secret cryptographic franking image key and the calculated franking image verification key.

A unit to invoice the postage fees for mail pieces of the same sender to a separate account and a unit for error correction is provided in the data center of the mail carrier wherein the central postage accounting is implemented when the authenticity of the integrity check code demonstrably exists.

The second means for security verification are programmed to make a determination of the mathematical relationship of the scanned key generation number to the copy of the last used key generation number, wherein a franking image verification key that corresponds to the current subsequent franking image key of the franking device, generated according to the first crypto-algorithm. The latter is applied z-times corresponding to the determined mathematical relationship, and the franking image verification key is used together with the copy of the currently used key generation number and with the device identifier to form a comparison integrity check code according to the second crypto-algorithm.

The invention has the following advantages compared to the prior art:

- The described franking devices of a system with central postage accounting do not need to be equipped with special security hardware. Since the fraud risk for mail carriers would be vanishingly small, the permission requirements are clearly reduced relative to franking systems with decentralized postage accounting. The described franking devices can be produced and be placed in circulation distinctly more cheaply than franking machines with decentralized postage accounting.
- Franking imprints for central postage accounting can be designed very simply. Only the device identifier authenticated once is necessary.
- Additional information of conventional franking imprints (such as date, postage value, mail product code, for example) do not need to be contained in the franking imprint because they can be all be determined in the course of the central postage accounting.
- a communication via a communication network is possible as needed within the mail transport system and does not need to occur for every piece of mail.

DESCRIPTION OF THE PREFERRED EMBODIMENTS

Figure 1A:
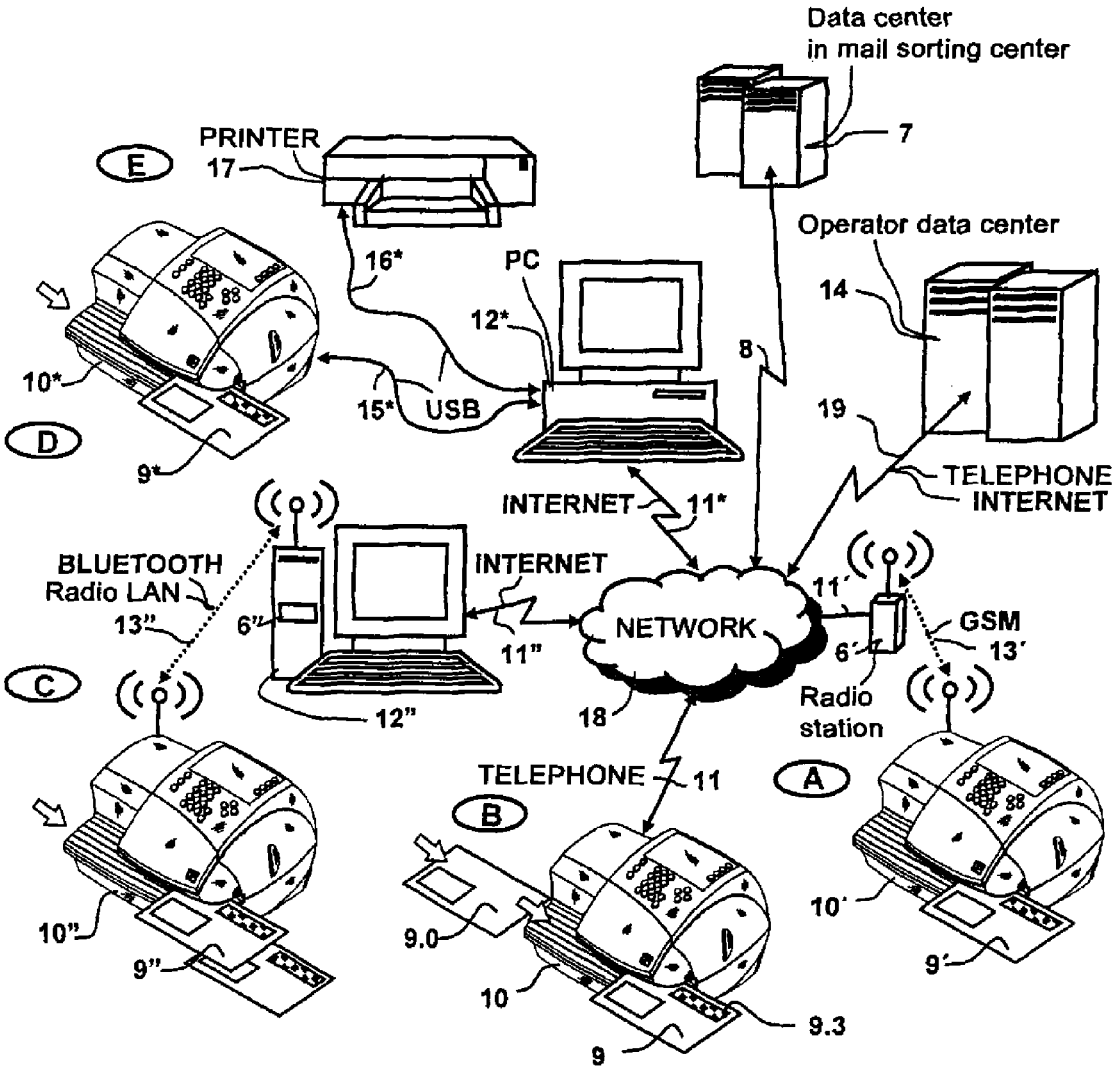
FIG. 1*a* schematically shows a franking system with different variants of communication connections.

A franking system with different variants of communication connections between an operator data center and franking devices is shown in FIG. 1*a*. Small, mobile franking devices 10, 10', 10", 10* can generate franking imprints with their printer module, in which franking imprints a device identifier is embedded in a forgery-safe manner. Such franking devices are subsequently also designated herein as postal identity management devices (PIMDs). Each PIMD is in contact with the operator data center 14 via a communication connection 11, 11' 11", 11* via network 18 and a communication connection 19. There it registers the device identifier for its users and additional services are offered. Each PIMD can print franking imprints 9.3 on letters 9 and/or envelopes for mail pieces that are subsequently provided to a mail sorting center data center 7 for further mail transport. The letter center 7 is connected via a communication connection 8 with the network 18 and can likewise communicate with the operator data center 14 as, conversely, the operator data center 14 can communicate with the mail sorting center data center 7. For example, the communication connections 8 and 19 enable a communication via Internet or telephone network.

Each PIMD is connected via the network 18 with the operator data center 14. To secure the communication connection, a symmetric or asymmetric encryption can be used. For example, a secret first key is transmitted encrypted from the franking device via the operator data center 14 to the mail carrier data center 7. The secret first key can be encrypted in the franking device by means of a private key and be decrypted in the operator data center by means of a public key. For example, the operator data center 14 can likewise communicate with the mail carrier data center 7 via network 18 over a connection secured by encryption or via a dedicated line (not shown). One or more different techniques can thereby be used. Some connection variants are shown in FIG. 1*a:*

A) A PIMD 10' connects via a radio WAN 13' (for example GSM, UMTS modem) with a radio station 6' which can be connected via the communication connection 11', network 18 and the communication connection 19 with the operator data center 14.

B) A PIMD 10 can be connected directly with the operator data center 14 via a wired telephone network 11, 18, 19.

C) A PIMD 10' is connected via a radio LAN (WiFI) or radio personal network (Bluetooth) 13" with a radio station 6' of a PC 12" that can connect via communication connection 11" (for example the Internet), network 18 and communication connection 19 with the operator data center 14.

D) A PIMD 10* is connected via a point-to-point connection (USB) 15* with a PC 12* that can connect with the operator data center 14 via communication connection 11*(for example the Internet), network 18 and communication connection 19.

E) The function of a PIMD is integrated into the PC 12*. This can occur via a corresponding software and/or hardware (plug-in module not shown). The PC 12* is engaged in a communication connection with a commercial printer 17* via a point-to-point connection (USB) 16* as well as with the operator data center 14 via communication connection 11*(for example the Internet), network 18 and communication connection 19.

The fundamental mode of operation of the system is divided into the method steps:

transmission of the first franking image key IDAKey1 for remote evaluation of franking images to be inspected on mail pieces, calculation of a franking image before generation of a franking, wherein a new franking image key is derived according to a first crypto-algorithm from a predecessor of the franking image key for each new franking image key, and wherein an integrity check code M is generated based on the new franking image key, a key generation number i, a device identifier g of the franking device and a second crypto-algorithm, wherein the franking image possesses at least the device identifier g of the franking device, the key generation number i and the integrity check code M, transport and commission of mail pieces to a mail sorting center of the mail carrier after the franking, scanning and verification of franking images at the mail carrier, wherein the integrity check code M is cryptographically verified in that a comparison integrity check code is formed for comparison with the printed integrity check code, and wherein fees are recorded for central billing, which fees are charged to the sender of the mail pieces with temporal decoupling from the billing at the end of the accounting period, and error correction in the verification.

Calculation of Franking Imprints

In order to produce a franking, the sender determines the required postage in a known manner and starts the franking with his PIMD. The PIMD can contain an integrated scale and/or a postage calculator. The PIMD optionally prints plain text information such as the required postage value, the current date and possibly information for the mailing (product designation etc.).

The PIMD moreover prints a marking (for example a machine-readable barcode) that contains the following information.

g A device ID is the identifier of the franking device that can be used for its identification.

If a customer uses multiple different franking devices, he uses various unique device identifiers for each franking device. Each device identifier is uniquely associated with a customer account which is charged with the transaction volumes of all associated franking devices at the end of every accounting period (for example at the end of the month).

i A key generation number.

A step-by-step variation of the key generation number i by any established numerical value h can ensue. The key generation number i is increased or reduced with each franking, advantageously by the value h=1. A cryptographic key $IDAKey_i$ is associated one-to-one with every key generation number, which cryptographic key $IDAKey_i$ is used to calculate integrity check codes of franking imprints (indicia).

M An integrity check code.

This code M is calculated with the use of an algorithm for a message authentication code (MAC) via the data designated above (Henk C. A. van Tilborg: Encyclopedia of Cryptography and Security; Springer-Verlag New York, 2005, pages 361-367).

A hash-based message authentication code (HMAC) is advantageously used (ibid., pages 14 and 267). A secret cryptographic key of the sender is advantageously used according to the following formula (1) for HMAC formation:

$$M \leftarrow \mathrm{HMAC}(IDAKey_i, f(g,i,IDAKey_i)). \quad (1)$$

F is hereby a function with the parameters g, i and IDAKeyi. The function f advantageously delivers as a result the string g||i consisting of the bit-by-bit serial printing of the parameters g and i:

$$M \leftarrow \mathrm{HMAC}(IDAKey_i, g||i). \quad (2)$$

Given initialization of a franking device, its key generation number is set to one and an initial cryptographic (first) key $IDAKey_1$ is generated. During the subsequent registration of the franking device, the franking device identifier g, the first key generation number i=1 and the associated first cryptographic key $IDAKey_1$ are transmitted to the mail carrier. In this way the mail carrier receives the same secret cryptographic key that the franking device uses.

The key generation numbers and cryptographic keys received by the mail carriers and administered as a result are designed in the following with j or, respectively, $IDAKey_j$. The goal is to keep the local generation number i in a franking device and its local copy j on the mail carrier side in sync. How this goal is achieved is explained in more detail using the subsequently covered method steps of verification of franking imprints and error correction.

After every franking, the key generation number i in the PIMD is increased by one and a new cryptographic key $IDAKey_{i+1}$ is derived from the current key $IDAKey_i$ according to formula (3):

$$IDAKey_{i+1} \leftarrow \mathrm{hash}\ (i, IDAKey_i) \quad (3)$$

The formation of a hash value according to a hash function also proceeds from, among other things, Henk C. A. van Tilborg: Encyclopedia of Cryptography and Security; Springer-Verlag New York, 2005, pages 256-264).

The key generation number i and the cryptographic key $IDAKey_i$ are used for the i-th franking after initialization of the franking device. In this way it is ensured that every cryptographic key is used for at most one franking.

Verification of Frankings

The franked mailings are supplied to the desired mail carrier, as is known. The mail carrier sorts the mailings, automatically reads the franking imprints (including the contained barcodes), subsequently transports the mailings to the destination address and delivers them there. The present invention assumes that all mailings are read before sorting and their barcodes can be nearly 100% recognized and correctly decoded.

Upon reading the mailings, the plain text information is evaluated and used to determine the postage value. In one embodiment, the postage value can simply be read off. In a second embodiment, the printed postage value can be checked by random sampling. In a third embodiment, the postage value is not printed and read at all but rather is directly determined in the mail sorting center from the physical parameters (length, width, thickness, weight, additional services) of the mailing.

Furthermore, upon reading the content of the barcode is determined, evaluated and checked as follows:

(I) First, it is checked by means of a first verification step whether the franking device identifier g is known in the database of the data center. If the verification is successful, the mail carrier determines from its database the local copy j on its own end for the last read key generation number i and the associated franking image verification key $IDAKey_j$.

(II) Subsequently, by means of a second verification step it is checked whether the local copy J of the current read key generation number i+x is greater than, or whether i−x is smaller than the last local copy j of the key generation number i that is stored as the last from this franking device with the same device identifier g. If this check is successful, the current franking image key $IDAKey_J$ is calculated. In the general case, J=j+x applies for rising or J=j−x applies for falling key generation numbers. Due to a constant increment value h and the number z of the steps, the value x of the variation of the key generation number results overall according to formula (4) as:

$$x = h \cdot z \quad (4)$$

Given an increment value h=1 and the number z=1 of steps (i.e. in the preferred normal case J=j+1), the current key is calculated according to the following formula (4):

$$IDAKey_J \leftarrow \mathrm{hash}\ (j, IDAKey_j). \quad (5)$$

Alternatively, the verification does not always have to be successful given an occurrence of scanning or reading errors. The appertaining mail piece is rejected. The next following mail piece of the same sender exhibits a larger change in the current read key generation number because the number z of the steps has increased with the interval value h=1. The above calculation rule is consequently adapted, and (J−j) 1/h=z is recursively applied in the data center. In the preferred normal case (h=1), the aforementioned next following mail piece of the same sender has a franking image with a current read key generation number i+2 and a current franking image key $IDAKey_{i+2}$. The value of the local copy j consequently must be changed corresponding to the value x of the variation (i.e. by x=2), and the formula (5) must be applied again together with the last calculated franking image verification key for the rejected mail piece in order to be able to derive a current franking image key.

(III) In a third verification step, the read integrity check code M is subsequently cryptographically verified by checking the following equation:

$$M = \mathrm{HMAC}(IDAKey_J, f(g,J,IDAKey_J)). \quad (6)$$

Wherein f ( . . . ) a function with the parameters g, J and $IDAKey_J$.

The function f ( . . . ), which advantageously is a combination of the parameters g, J into one (alphanumerical) number, is encrypted with the secret franking image key $IDAKey_J$ in order to generate a numerical value as a basis for the HMAC formation. If it is advantageously processed according to formula (2), for the security verification it is also provided in a simplified manner that it is checked according to equation (7) in order to cryptographically verify the integrity check code M:

$$M = \mathrm{HMAC}(IDAKey_J, (g||J)). \quad (7)$$

If this check is also successful, the determined postage amount is added to the electronic device account that the mail carrier directs to the data center of the mail sorting center for this device. All fees accrued in this device account are charged to the appertaining customer account at the end of the accounting period.

Error Management with Error Correction

If the verification by means of the first verification step (I) fails, an invalid sender identifier was apparently used. Transmission errors would already have been compensated via the error correction of the employed barcode. It is up to the respective mail carrier to define an error management for this case. Management possibilities are:

a) The letter is sent back to the sender.

b) The mail transport can be ended and the letter is destroyed.

c) The addressee can be informed and asked whether he would like to receive the letter at his own cost. In the event that this is not the desire of the addressee, the method can proceed as described under a).

If the verification by means of the second verification step (II) fails, either a replay offense exists or the controller of the PIMD is malfunctioning. In each case, the mail carrier prints the last stored key generation number of the appertaining franking device on the mailing and returns this to the operator of the registered franking device. Additionally, the operator of the registered franking device should be notified electronically (e-mail, SMS) about the return so that the operator in the meantime does not frank additional mailings with incorrect key generation numbers.

If the verification by means of the third verification step (III) fails, a fatal error exists since the cryptographic keys would have to coincide as well if the key generation number i of the generating PIMD and its copy j in the checking mail sorting center coincide (i.e. check (II) was successful). In this error case a new initialization and registration of the PIMD must be arranged.

A new initialization can preferably occur in that the data center 7 of the mail carrier generates a new franking image key $IDAKey^*_j$ and determines a difference value A according to the following (8):

$$\Delta \leftarrow IDAKey_1 \; XOR \; IDAKey^*_j \tag{8}$$

(XOR designates the Boolean operation of the per-bit exclusive-OR). The difference value Δ is subsequently printed on the return mailing that is sent back to the sender of the mail piece. The difference value Δ is additionally transmitted electronically to the data center 14 of the operator of the registered franking device. Since the first franking image key is known to the operator data center and is logically linked by an exclusive-OR function with the new franking image key, the new franking image key $IDAKey^*_j$ can be determined. The new franking image key can now be sent or, respectively, transmitted to the appertaining PIMD in the manner of secure communication. The steps required in the PIMD initialization can be applied with corresponding modification so that the PIMD adopts the new franking image key.

Figure 1B:
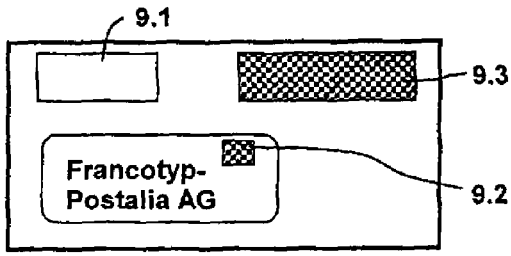
FIG. 1*b* schematically illustrates a printed front side of a letter.

FIG. 1*b* shows a principle representation of a printed top side of a letter with a first field for the sender address or advertisement, with a second field 9.2 for a marking in the recipient address field, and with a third field 9.3 for the franking. The aforementioned marking and/or the franking contains a manipulation-safe device identifier. Naturally, the device identifier/franking imprints can be printed out in code in the 2D barcode. Due to the small data quantity, the device identifier can also be printed out as a 1D barcode. For example, GS1-128 (UCC/EAN-128) or USPS OneCode are suitable here. These barcodes are reliably readable at high speed and simultaneously allow the reader to automatically correct a certain error rate. They are already read in many mail sorting centers and in this require no additional investment in scanner technology.

Alternatively, OCR fonts could also be used in order to print and read the device identifiers.

The amount of information required for an authenticated device identifier significantly depends on the number of possible senders. Given 4 bytes that are required for a checksum and a number of x million possible senders, at least a number of $\#l=\log_{256}(x\cdot 10^6)+4=\log_{256}(x)+6\cdot\log_{256}(10)+4\approx\log_{256}(x)+6.5$ bytes are required for the encoding of a device identifier. A postal market of up to 17 million senders therefore requires device identifiers 7 bytes in length, a market of up to 4 billion senders requires 8 bytes in length and a market of up to 1.09 trillion senders requires 9 bytes in length. Overall, 1.6 million franking machines are presently in existence in the US market. A 7-byte device identifier appears to be sufficient here.

If the franked mail pieces pass through the corresponding sorting systems of the postal mail sorting centers, the imprints are read and the printed postage, the device identifier and additional information are registered, checked and evaluated in a data center of the postal mail sorting center. The postal service performed for each sender is billed to him using this evaluation.

Figure 1C:
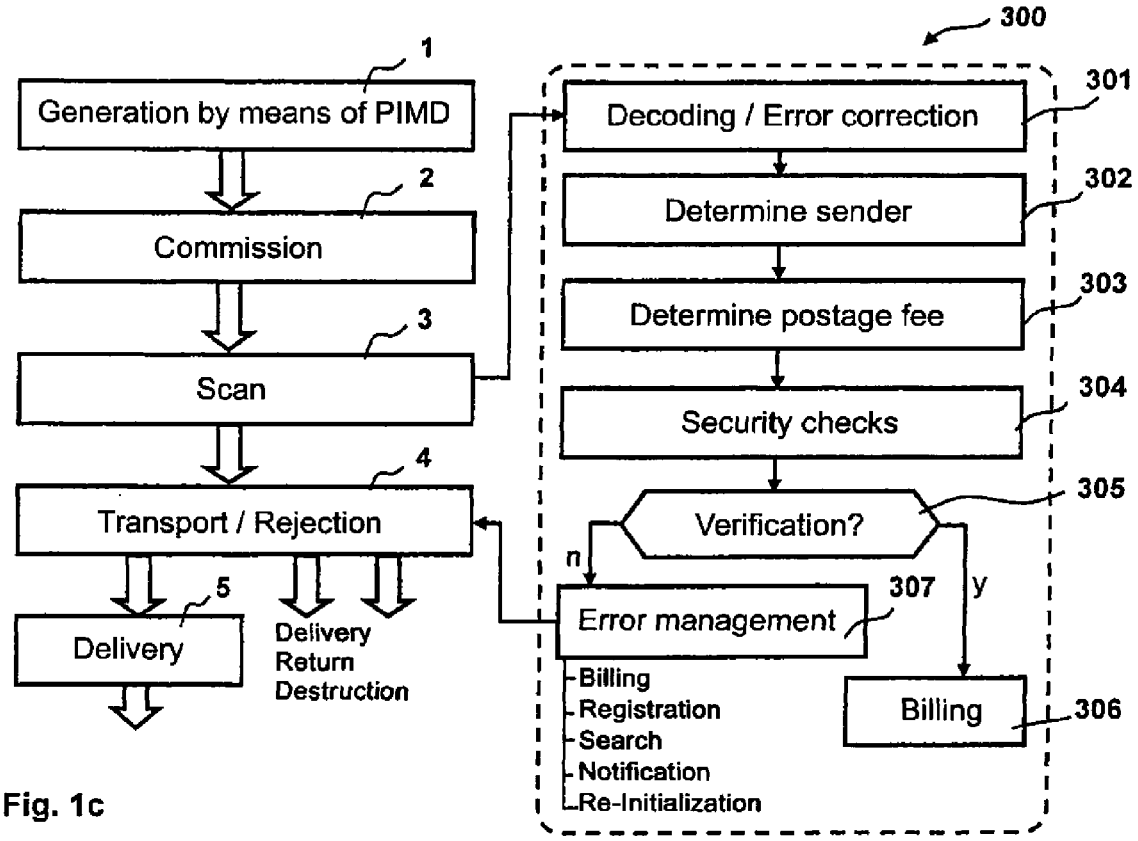
FIG. 1*c* is a flowchart of the procedure that ensues at the mail carrier in accordance with the invention.

FIG. 1*c* shows a schematic representation of the workflows at the mail carrier. After a generation of a marking and/or franking in a first Step 1 which comprises a generation of a manipulation-safe device identifier, a transport of the mail piece ensues. A white arrow indicates the transport direction.

The fundamental mode of operation in the mail sorting center of the postal carrier assumes: a commission of the mail piece in the mail sorting center in a second Step 2; a scanning and evaluation of a marking and/or franking image in a third Step 3; the further transport of the mail piece in the fourth Step 4; and its delivery in the fifth Step 5; or its rejection in the fourth Step 4. The information from the scanned marking and/or the franking image is processed further in the data center of the mail sorting center in an evaluation routine 300 for its evaluation. The evaluation in Routine 300 includes at least the following steps:

301 decoding and error correction of the information after scanning,

302 determination of the sender,

303 determination of the postage fee,

304 security verifications,

305 query as to verification and

306 billing or

307 error management.

A scanner in the mail sorting center and a first evaluation means in the data center of a mail carrier are provided that are communicatively connected with one another in order to implement a decoding and error correction of the information after scanning in Step 301, a determination of the respective sender in Step 302 and a determination of the postage fee in Step 303. The first evaluation means comprises a database that is coupled with a server.

Alternatively, the order of Steps 302 and 303 can be exchanged, or the two steps can be executed in parallel.

It is provided that the determination (302) of the respective sender comprises a search for the device identifier g of the franking device in a database of the mail sorting center or data center, and for the associated, stored copy j of the last used key generation number for which an associated stored franking image key exists, the security check (304) of each franking image, a determination of the mathematical relationship of the scanned key generation number i±x to the copy j of the last used key generation number as well as a cryptographic verification of the integrity check code M, wherein a franking image verification key $IDAKey_J$ which corresponds to the current following franking image key $IDAKey_{i\pm x}$ of the franking device is generated according to the first crypto-algorithm, wherein the latter is applied z times corresponding to the determination of the mathematical relationship, and wherein the franking image verification key $IDAKey_J$ is used together with the copy J of the currently used key generation number i±x and with the device identifier g to form a comparison integrity check code Mref according to the second crypto-algorithm.

Second means (advantageously a server that is secured against misuse) for security verification of each scanned franking image are provided in the data center.

After a pass through Steps 301 through 304, a query ensues as to a verification of the franking device identifier g. If a verification is possible after a pass through Steps 301 through 304, a billing of the postage fee in the framework of the central postage accounting then ensues in Step 306 to the account of the sender determined in Step 302. However, if no verification is possible after a pass through Steps 301 through 304, this is established in the query step 305 and the workflow branches to Step 307 for error management. The verification of frankings and the three verification steps were already explained above. In the framework of the error management, a deviation signal is generated in order to prevent the further transport of the mail piece in the fourth Step 4 and in order to initiate the sorting out of the mail piece instead. The mail piece is transported to the recipient if the addressee (recipient) of the mail piece has been notified and has agreed to a delivery. The mail piece can be transported back to the sender when the sender of the mail piece has been notified and has agreed to a return. Otherwise, an undeliverable mail piece is destroyed. In the framework of the delivery to the addressee (recipient) of the mail piece, a billing likewise ensues, but to the recipient name.

Additional investigations and even a registration of undeliverable mail pieces can ensue in the framework of the error management.

Figure 2:
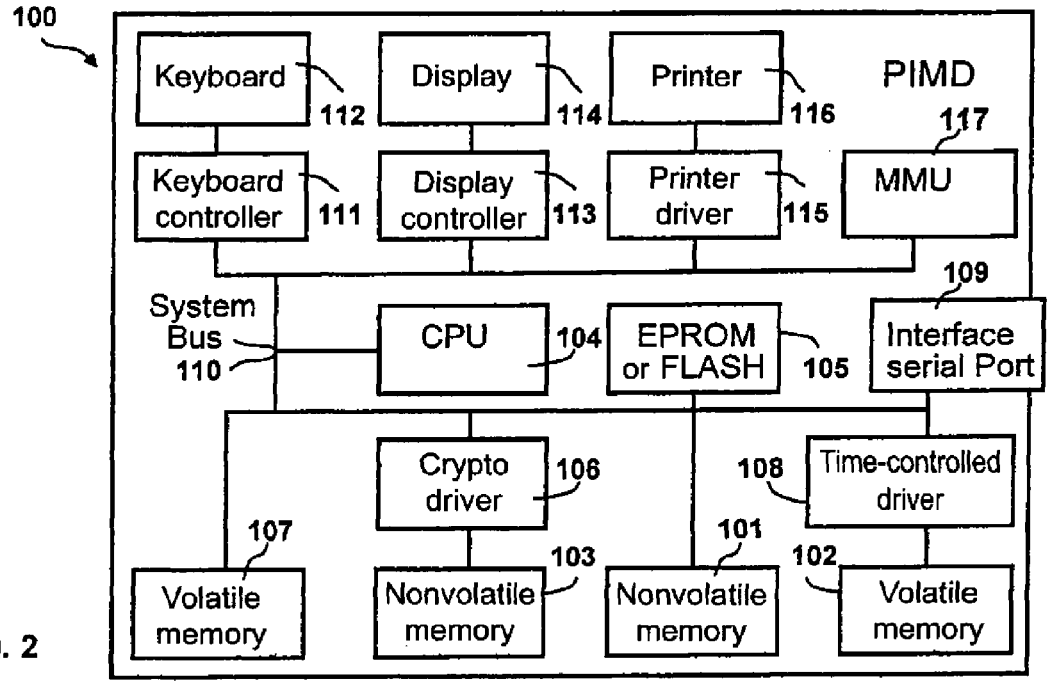
FIG. 2 is a block diagram of a Postal Identify Management (PIMD).

A block diagram 100 of a franking device (PIMD) is shown in FIG. 2. The franking device has a keyboard 112, a display unit 114 (LCD) and a printer module 116 (printer) that are connected with a respective associated electronic controller (keyboard controller 111, display controller 113, printer driver 115). Furthermore, it has a processor 104 (CPU), a memory management unit 117 (MMU) and volatile and non-volatile memory (volatile memory 102, 107 and non-volatile memory 101, 103) and a common interface 109 with serial input/output for data exchange with an operator data center. The communication interface can be wired (for example USB, LAN etc.) or wireless (for example WLAN, GSM, Bluetooth). There is additionally a time-controlled driver 108 (time threshold) that accesses a volatile memory 102 and a cryptographically encrypted driver 106 that accesses a non-volatile memory 103. The time-controlled driver 108 (time threshold) writes data to the volatile memory 102 (RAM, SD-RAM) and deletes these data as soon as these data have no longer been accessed for a time set in the operating program (time out). The deletion occurs via automatic overwriting of the data with bytes randomly generated by the driver. If it is subsequently sought to read the data, the driver outputs only the previous, randomly set data.

The cryptographically encrypted driver 106 writes data in encrypted form into the non-volatile memory 103 (for example flash), for which it uses a permanent programmed key of a symmetric block cipher. If these data should subsequently be read out again, the driver first decrypts the data with the same permanent programmed key.

The program code to control the franking device advantageously exists in a program memory 105 (NV memory)—for example in a flash memory—but can also alternatively exist in an EPROM module. The later variant is inexpensive but not as flexible because an exchange of the operator program requires an exchange of the EPROM module. The communication within the franking device runs via an internal bus 110 and is controlled by the memory management unit 117 (MMU) upon storage of data. The volatile memory 107 is provided as a working memory.

The communication interface 109 can be connected via a (shown) internal or external modem with an operator data center or with another suitable communication device for data exchange. The communication connections, the communication network and the communication devices at the ends of the communication connections form the communication means in a known manner.

The aforementioned means 103 through 107 form a key generation means that generates a new franking image key via calculation for every new franking image. The immediately preceding franking image key thereby forms the basis. The latter and a communication key are both stored in the non-volatile memory 103. The calculation is implemented using a first and second crypto-algorithm before the franking, wherein a first integrity check code based on the second crypto-algorithm is generated for a first franking image, wherein for every subsequently franking image a subsequent franking image key is derived from a predecessor of the franking image key according to the first crypto-algorithm and an integrity check code is generated based on the subsequent franking image key, a key generation number, a device identifier of the franking device and the second crypto-algorithm.

A PIMD 10 can communicate securely with its operator data center 14, for which a communication protocol authenticated in both directions and optionally encrypted is typically used. Typical methods are based on a protocol for key agreement (Henk C. A. van Tilborg: Encyclopedia of Cryptography and Security; Springer-Verlag New York, 2005, 325) or key establishment.

Figure 3:
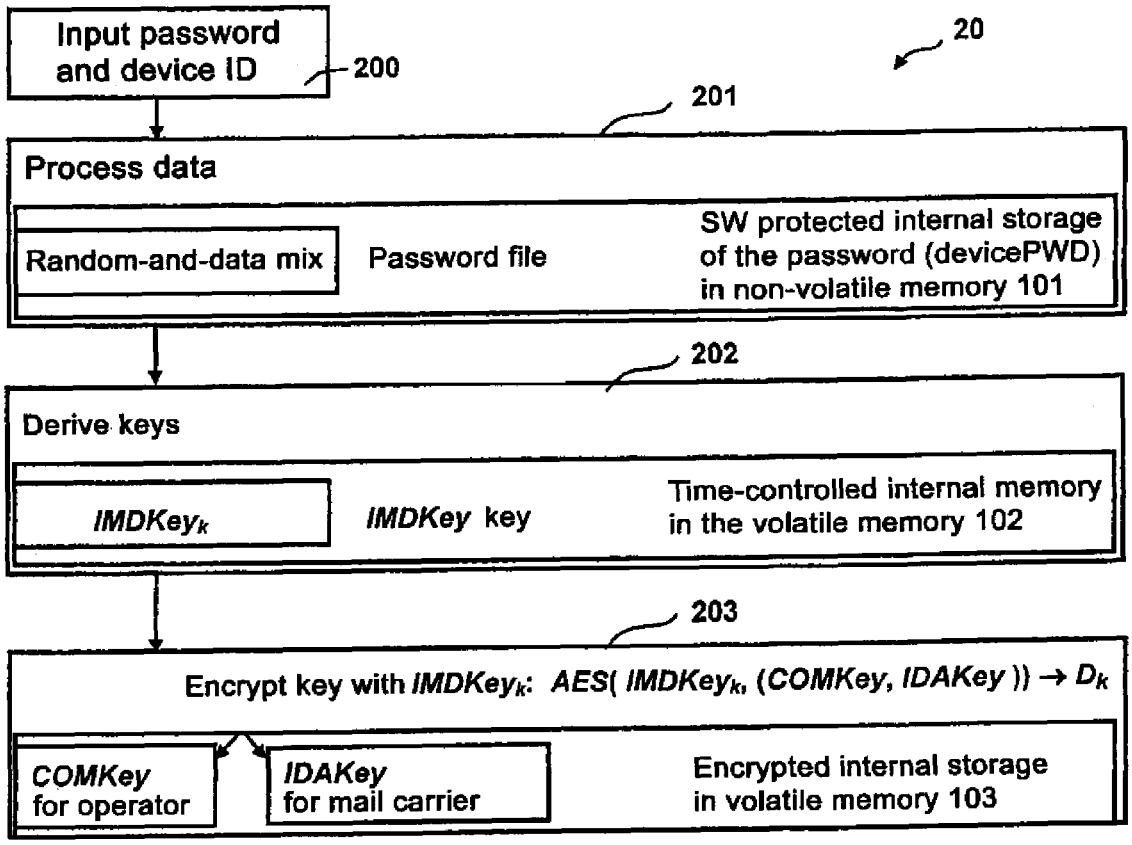
FIG. 3 illustrates the levels of the memory protection of a PIMD.

A presentation of the levels of memory protection is shown in FIG. 3. After input 200 of a device identifier g (device ID) and the current password, a first routine 201 is run to process the data in order to form a password via a random-and-data mixture (salt & hash) and to internally store said password with software protection in a file in the non-volatile memory 101. The first routine 201 thus leads to a password storage on a lower level of the memory protection. After the first routine 201, a second routine 202 follows to derive an internal encryption key IMDKey and for its time-controlled storage in an IMDKey file in the volatile memory 102. The second routine 202 thus leads to a volatile storage on a middle level of the memory protection.

After the second routine 202, a third routine 203 follows to encrypt keys COMKey and IDAKey by means of the internal encryption key IMDKey and an encrypted internal volatile storage of data in volatile memory 103, wherein the data contain the encrypted key. The third routine 203 thus leads to a volatile storage on an upper level of the memory protection.

The PIMD advantageously uses two keys or key pairs to secure its interactions with neighboring systems. A communication key COMKey is used for the electronic communication with the operator data center. This can be a symmetric key. Alternatively, an asymmetric key pair can be used. In the case of an asymmetric key pair, we designate the private communication key as COMPrivKey and the public communication key as COMPubKey.

A secret franking image key IDAKey is used to form the integrity check code M for the franking imprints that are read and evaluated by the appertaining mail carrier in the mail carrier data center in the mail transport, wherein said integrity check code M is printed on the mail piece upon franking. This is advantageously a symmetric key.

Both keys COMKey and IDAKey or, respectively, COMPrivKey and IDAKey are stored in an encrypted internal memory region (for example in volatile memory 103) of the postal identity management system (PIMD) and are only decrypted as needed. After use, the plain text copies of both keys are immediately deleted and the corresponding memory regions are overwritten with random bit patterns so that the clear keys cannot be read by unauthorized parties.

An internal encryption key IMDKey for a symmetric block cipher (for example Advanced Encryption Standard (AES)) is used for the encryption of the secret communication key COMKey or the private communication key COMPrivKey and of the secret franking image key IDAKey. This internal encryption key (IMDKey) is not permanently stored in plain text but rather is respectively, algorithmically derived as needed from the password. Plain text copies of the internal encryption key IMDKey are temporarily stored in the volatile memory 102 (time controlled internal storage) and deleted there again as soon as their residence time (time-out) has expired without them being used.

A random bit string (salt) is generated for a new password (Henk C. A. van Tilborg: Encyclopedia of Cryptography and Security; Springer-Verlag New York, 2005, page 541). The random bit string is attached to the password selected by the user. The result is mapped to a hash value (for example SHA256) via a hash function (ibid., hash function, page 256-264) and the franking image key IDAKey is derived from this in that the hash value is either used directly or is subjected to a hash function. The pair composed of salt and hash value for a password are subsequently stored in the password file, indexed according to passwords (soft protected internal memory). In order to protect this memory against unauthorized reads, software obfuscation techniques are used that, for example, store a data set in multiple parts that are present at different addresses in the memory 101.

The main processes of the operation of a PIMD are:

an initialization (FIG. 4) of the PIMD, a change (FIG. 5) of an existing password and a calculation (FIG. 6) of the franking imprint.

Belonging to the sub-processes of the operation of a PIMD are:

a device ID authentication (FIG. 7), sending (FIG. 8) franking image keys (IDAKey).

Figure 4:
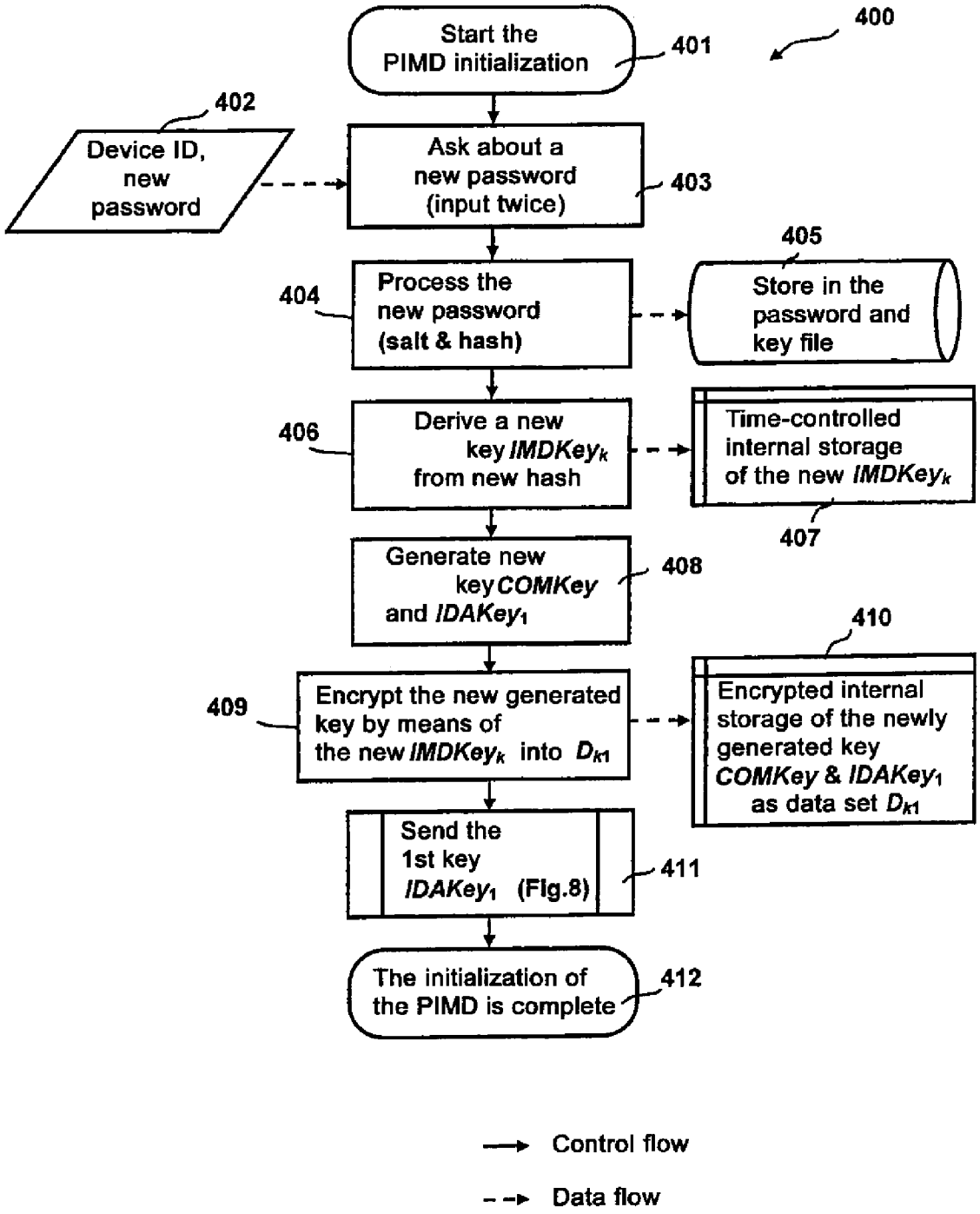
FIG. 4 is a flowchart for the initialization of a PIMD.

FIG. 4 shows as routine 400 a flow chart for initialization of a PIMD. After the start of the PIMD initialization in Step 401 and an input of the device ID and of a new password into the PIMD in Step 402, a query for new passwords ensues in Step 403. For example, given a password input via the keyboard of the franking device the new passwords are those that have been input twice. A duplicate input of the passwords must consequently ensue the first time that a password is input via keyboard. However, neither a repeated input of the same passwords nor a one-time input of a password should be precluded by this, wherein the franking device can detect in another way that a routine 400 should run to initialize a PIMD. For example, an input of the type of routine that should run ensues given a first input and a password input ensues in a second input, or vice versa.

Alternatively, variants of the password input other than by hand are possible, assuming that the franking device possesses a correspondingly matched interface. For example, the password input can ensue via chip card, which assumes that the franking device possesses a write/read unit for chip cards. A duplicate input of the passwords also does not need to occur when it can be established in another manner whether it is intended to replace a previous password with a new, current password.

A processing of the password via a known process (salt & hash process) which has already been indicated above in connection with FIG. 3 subsequently ensues in Step 404. Storage of the new password in a password key file in non-volatile memory 101 ensues in Step 405. Following Step 404, a new encryption key $IMDKey_k$ is derived in Step 406 from the new hash value that was formed in Step 404. After deriving the new encryption key $IMDKey_k$ in Step 406, the new encryption key $IMDKey_k$ is internally stored in the volatile memory 102 with time control in Step 407. A generation of a new communication key COMKey and franking image key $IDAKey_1$ can now ensue in a Step 408 following Step 406. These two keys are encrypted into data $D_{k1}$ in a crypto-driver 410 in the following Step 409, which data $D_{k1}$ are internally stored in a volatile manner in the subsequent Step 410.

The franking image key $IDAKey_1$ is a first key which is used to form an integrity check code M. The COMKey is a communication key for the electronic communication with the operator data center. An encryption of both keys COMKey and $IDAKey_1$ ensues in Step 409 via application of the new encryption key $IMDKey_k$ upon encryption according to any of the known encryption algorithms, for example according to the Advanced Encryption Standard (AES) algorithm according to formula (9):

$$\mathrm{AES}(IMD\mathrm{Key}_k,(COM\mathrm{Key},IDA\mathrm{Key}_1))\rightarrow D_{k1} \tag{9}$$

Figure 8:
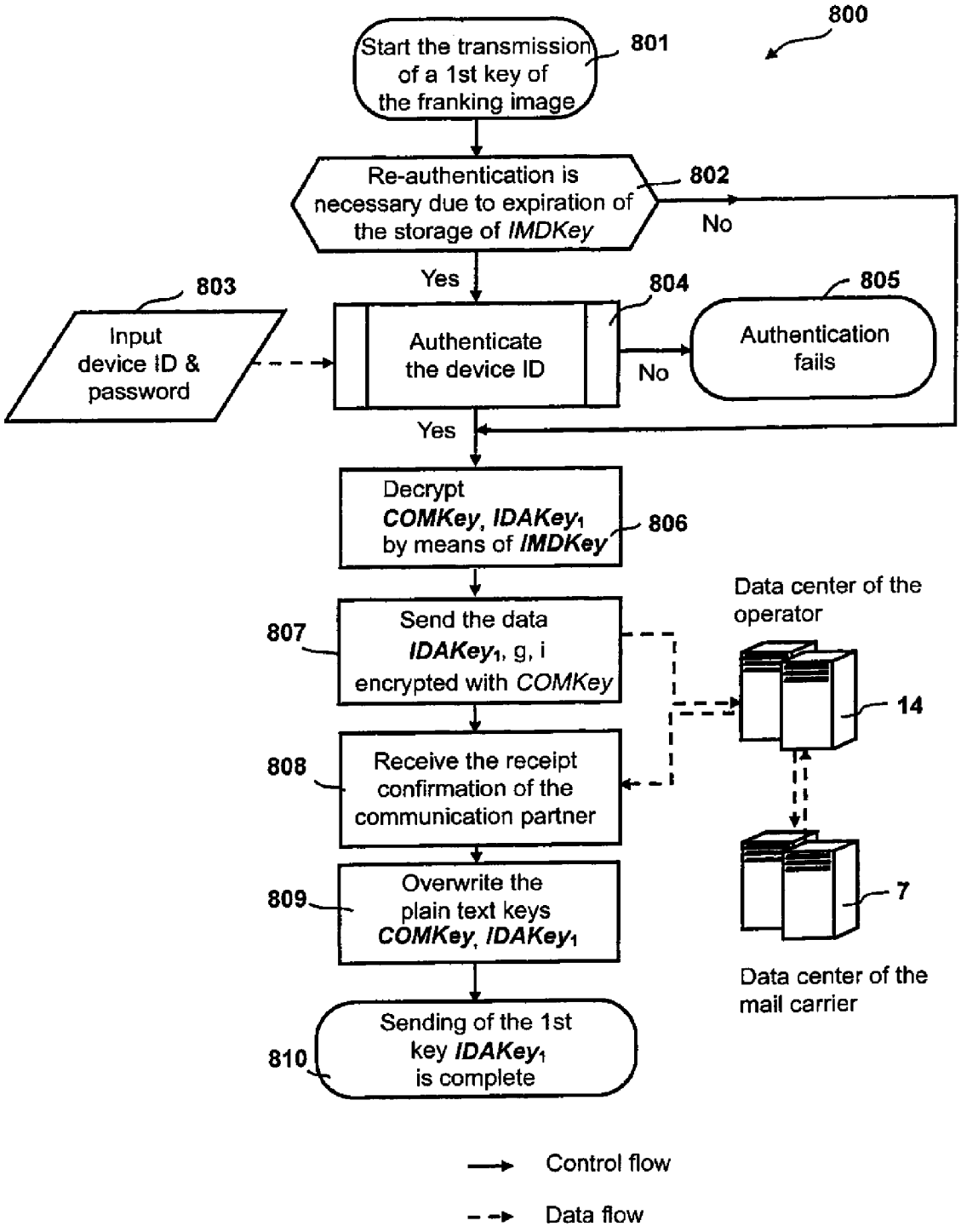
FIG. 8 is a flowchart for sending a franking image key of the PIMD to the mail carrier data center.

After the internal storage of the data Dk1 of the encryption key COMKey and $IDAKey_1$ has occurred in Step 410, in the subsequent Step 411 the sub-process according to FIG. 8 is implemented and the first franking image key $IDAKey_1$ is sent. Aside from the first franking image key $IDAKey_1$, the device identifier g of the franking device and the key generation number i are also transmitted to the data center of the mail carrier during the initialization of the franking device. The initialization of the PIMD is finished in the subsequent Step 412.

The mode of operation of the initialization of a PIMD belongs among the main processes and ends with the transmission of the generated first franking image key $IDAKey_1$ to the mail carrier via a secure communication protocol.

The mail carrier thereupon registers the new franking device with its device identifier g, its first key generation number i and the associated franking image key $IDAKey_i$ which are used to form an integrity check code M. The first key generation number i advantageously has a value of one.

Figure 5:
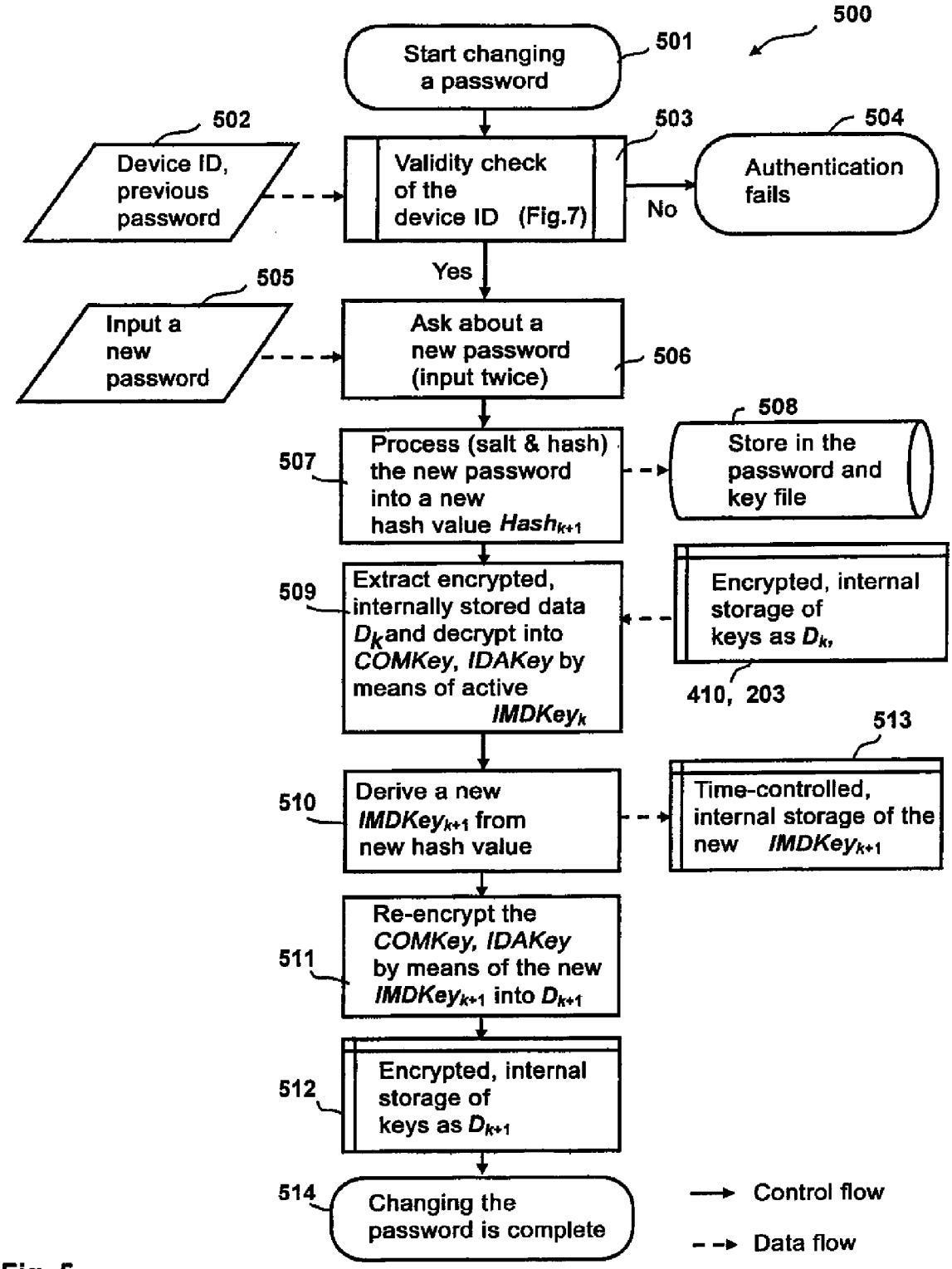
FIG. 5 is a flowchart for changing a password.

FIG. 5 shows as a routine 500 a flow plan upon changing a device password. The routine 500 of the PIMD leads to changing the password, i.e. to updating the password of the PIMD. A validity check of the device ID ensues in a third step 503 after the start of a changing of the password in the first step 501 and an input of the device ID and of the previous password into the PIMD in a second step 502. If the validity check of the device ID fails, the workflow branches to a fourth step 504 and the routine 500 ends.

Otherwise, in the event that the validity check of the device ID was successful the workflow branches to a sixth step 506 to query new passwords. After inputting a new password in the fifth step 505, a query of the newly input password can ensue in the sixth step 506. For example, a new password can be input twice in the fifth step 505 given a manual input via keyboard of the franking device, and such a duplicate input of a new password can be inquired after in the sixth step 506. Alternatively, it can be established according to other criteria whether the input of a new password is intended.

The user can thus establish a new password in that he inputs it identically twice. The franking device can possibly detected in a different manner that a routine 500 to change the password should run. Alternatively, other variants of the password input than by hand are possible, which assumes that the franking device has a correspondingly matched interface. A misuse of the device identifier g of the sender franking device is made more difficult with the password input, or alternatively by means of RFID identification, magnetic card, chip card, mobile device (cell phone, PDA) which can be communicatively connected with the franking device via a personal network (Bluetooth, USB, etc.).

After the authentication of the device ID in the third step 503 and the query in the sixth step 506 were successful, a processing of the new password into a new hash value Hashk+1 according to what is known as the salt & hash process ensues in a seventh step 507, the aforementioned process is identical to the first routine 201 for processing of the data that was already explained using the presentation in FIG. 3 or with the fourth step 404 of routine 400, which is run according to FIG. 4.

After the salt and hash process in the seventh step 507, the new password is stored in a password and key file in an eighth step 508 and the workflow navigates to a ninth step 509 to extract internally stored data $D_k$, wherein the data contain the encrypted key. The encrypted internal storage of the key in the volatile memory 103 already ensues in the form of data $D_k$ before routine 500 in Step 410 (FIG. 4) or 203 (FIG. 3). The extracted data $D_k$ are decrypted by means of the active internal key $IMDKey_k$ into both required keys in plain text. These are the secret franking image key $IDAKey_k$ and the secret communication key COMKey or, respectively, private communication key COMPubKey. Following the ninth step 509, in the tenth step 510 a derivation ensues of a new internal encryption key $IMDKey_{k+1}$ from the new hash value $Hash_{k+1}$ that was determined in the seventh step 507. In an eleventh step 511 following the tenth step 510, a re-encryption of the necessary keys ensues by means of the new $IMDKey_{k+1}$, wherein the required keys result from the decryption in the ninth step 509. For example, the re-encryption into the new encrypted data $D_{k+1}$ ensues again according to the Advanced Encryption Standard (AES) algorithm according to Formula 10:

$$\mathrm{AES}(IMDKey_{k+1},(COMKey_k,IDAKey_k))\rightarrow D_{k+1} \tag{10}$$

In a twelfth step 512 following the eleventh step 511, an internal volatile storage of the new encrypted data $D_{k+1}$ in the volatile memory 103 ensues again. Moreover, as a result of the tenth step 510 a time-controlled, internal volatile storage of the new internal encryption key $IMDKey_{k+1}$ ensues in the volatile memory 102 in a thirteenth step 513. The changing of the password is completed in the fourteenth step 514.

Figure 6:
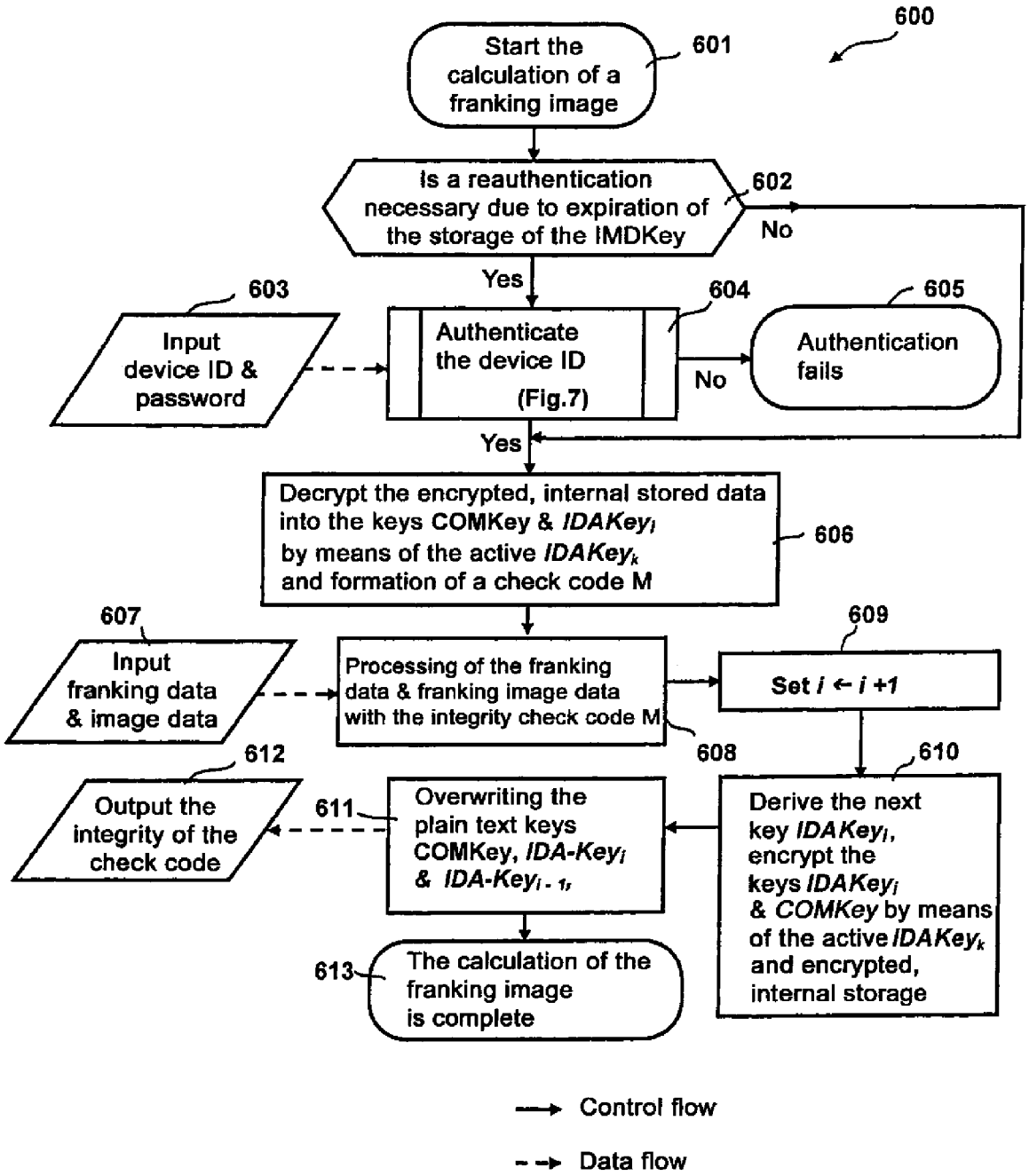
FIG. 6 is a flowchart for calculation of a franking imprint.

FIG. 6 shows as a routine 600 a flow chart to calculate a franking imprint. Routine 600 for calculation of a franking imprint belongs among the main processes. After the start of a processing of the data of a franking imprint in the first step 601, a query as to whether a new authentication of the device ID is necessary because the expiration of the IMDKey has occurred ensues in a second step 602.

If that is the case, a notification can then ensue (not shown, for example via display) which requires the user of the franking device to input the device ID and the password.

An input of the device ID and of the password subsequently ensues in a third step 603 before a sub-process of the operation of a PIMD for the purpose of an authentication of the device ID runs in a fourth step 604. If an authentication of the device ID is not possible, Step 605 is reached and a message is displayed that the authentication has failed.

Otherwise, when the query in the second step 602 returns that a new authentication of the device ID is unnecessary, or if the authentication of the device ID in the fourth step 604 was successful, the workflow branches to a sixth step 606. In the sixth step 606, the internally stored data $D_i$ encrypted in the volatile memory 103 are decrypted by means of the active $IMDKey_i$ into the plain text keys. These are the secret franking image key $IDAKey_i$ and the secret communication key $COMKey_i$ or private communication key $COMPubKey_i$. A formation of an integrity check code M according to the aforementioned formulas (1) or (2) now ensues.

After inputting franking data and franking image data in a seventh step 607, a processing of the franking data and franking image data together with the integrity check code M ensues in an eighth step 608 in order to generate a unique franking imprint as a result of Routine 600. Following the eighth step 608, in a ninth step 609 the key generation number i for the franking following the current franking is increased by one. After the incrementing in the ninth step 609, a derivation of a next encryption key $IMDKey_i$, an encryption of the key $IDAKey_i$ and $ComKey_i$ by means of the active $IMDKey_i$, and an encrypted internal storage of the keys $IDAKey_i$ and $COMKey_i$ ensue in a subsequent tenth step 610. An overwriting of the clear keys and of the encryption key in the volatile memory 102 and 103 ensues in a further eleventh step 611. A notification of the integrity of the check code can be output with a twelfth step 612. The routine 600 for calculation of a franking imprint is complete with the thirteenth step 613.

Figure 7:
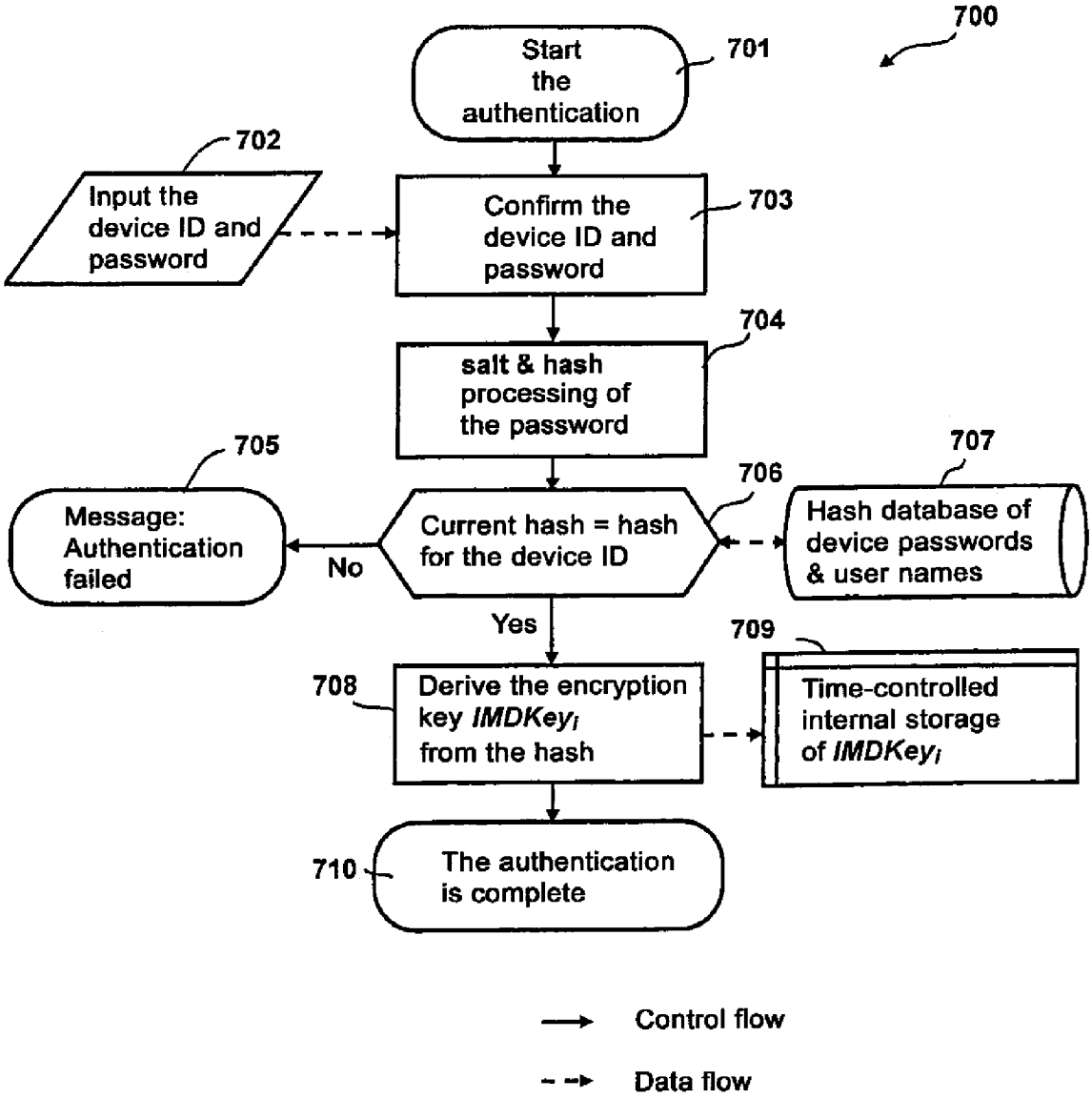
FIG. 7 is a flowchart for authenticity verification of a device ID.

FIG. 7 shows as a first sub-routine 700 a flow chart to validity-check a device ID. The sub-routine 700 belongs among the sub-processes of the operation of a PIMD, which sub-routine 700 is required in both main processes according to FIGS. 5 and 6 as well as in the sub-process according to FIG. 8. The mode of operation of the PIMD that is initiated upon running the sub-routine is started in a first step 701 and leads to the device ID authentication. After the start, an input of the device ID and of the password ensues in a second step 702 of the first sub-routine 700, wherein a fourth step 703 of the first sub-routine 700 in order to implement a salt & hash processing of the password is reached if the input is confirmed in the third step 703. A query as to whether a current hash value is equal to a hash value for the device ID subsequently ensues in a sixth step 706. A hash database with a list of device passwords and user names is thereby accessed in a seventh step 707 in order to find out the hash value for the device ID. If the query in the sixth step 706 results in no parity, the workflow branches to a fifth step 705 and a message is output that the authentication has failed.

Otherwise, the workflow branches to an eighth step 708 to derive an encryption key from the current hash value. The encryption key is internally stored with time control until the expiration of the storage of the IMDKeys ensues (Step 709). The tenth step 710 of the first sub-routine 700 is therefore also reached and the authentication is complete.

FIG. 8 shows as a second sub-routine 800 a flow chart upon sending a franking image key of the PIMD to the data center of the mail carrier. The sending of franking image keys IDAKey belongs among the sub-processes of the operation of a PIMD. The mode of operation of the transmission of an IDAKey of a PIMD is presented in detail using the second sub-routine 800. This second sub-routine is required when a PIMD transmits its IDAKey to the mail carrier at the end of its initialization. The sub-process of the transmission of the key of a franking imprint is started in a first step 801 and reaches a second step 802 for the purpose of querying whether a new authentication is necessary due to the expiration of the storage of the IDAKey. If that is the case, the workflow can branch to Step 804 of the second sub-routine. Under the assumption that an input (Step 803) of the device ID and of the password ensues, the first sub-routine 700 (i.e. a sub-process according to FIG. 7 for device ID authentication) can run in the indicated manner. Otherwise, the workflow branches to the sixth step 806 of the second sub-routine 800 if no new authentication due to expiration of the storage of the internal encryption key IMDKey is necessary. A new device ID authentication is therefore bypassed, and a decryption of the data D by means of the internal encryption key IMDKey into the clear keys COMKey and $IDAKey_1$ ensues in a sixth step 806 of the second sub-routine 800. An encryption of the first franking image key $IDAKey_1$ and of additional parameters (such as, for example, at least the device identifier g of the franking device and the key generation number i) by means of the communication key COMKey ensues in a subsequent seventh step 807 of the second sub-routine according to the formula (11):

$$\mathrm{AES}(COM\mathrm{Key}, F(g,i,IDA\mathrm{Key}_1)) \rightarrow D1 \quad (11)$$

as well as a transmission of the data D1 of the franking image key $IDAKey_1$ and additional parameters g and i (encrypted with a communication key COMKey) which have been linked with one another via a mathematical function F, wherein the mathematical function F is known to the data center of the mail carrier.

The data D1 are transferred to the data center of the mail carrier and received and decrypted there. The receipt of the franking image key $IDAKey_1$ and additional parameters g and i is confirmed.

A receipt of the receipt confirmation of the communication partner ensues in an eighth step 808 of the second sub-routine 800. The clear keys COMKey and $IDAKey_1$ are overwritten with random data in the subsequent ninth step 809 of the second sub-routine 800. The sub-process of the transmission of the first franking image key $IDAKey_1$ is therefore completed in the tenth step 810 of the second sub-routine 800.

The first franking image key $IDAKey_1$ advantageously travels indirectly to the data center 7 of the mail center via the data center 14 of the operator or, respectively, manufacturer of the franking device. The data center 7 of the mail carrier is alternatively the direct communication partner.

In the aforementioned calculation routine 600, a derivation of the next franking image key ensues in Step 610 after the formation of a check code M in Step 606 and after its processing in Step 608. The order can also be reversed in that a derivation of the next franking image key ensues first, and then a formation of a check code M and its processing are undertaken. Given the order of the steps, a corresponding order must naturally be selected in a verification of the franking data in the data centers so that a synchronicity is achieved again in the generation of new franking image keys after the scanning of the franking image or a marking of the mail piece.

The aforementioned password change routine 500 the query for a new password can ensue according to different criteria than were presented in the exemplary embodiment. The input of the new password itself can ensue in a different manner than was presented in the exemplary embodiment.

The aforementioned routines can be adapted to the different mail regulations for various countries and be reasonably applied.

Although mail pieces, letter envelopes and franking strips are mentioned herein, other forms of print goods should not be precluded. Rather, all mail pieces that can be provided with a franking image by franking devices should be included. The application of a franking image encompasses the application of a printed marking.

The application of a franking image is not limited to a printing of a mail piece; other forms of the application of at least one franking image or one marking also are encompassed.

Although modifications and changes may be suggested by those skilled in the art, it is the intention of the inventors to embody within the patent warranted hereon all changes and modifications as reasonably and properly come within the scope of his contribution to the art.

I claim as my invention:

1. A method for operating a mailing system, comprising:

initializing a franking device in a processor of the franking device by (a) generating a first franking image key $IDAKey_i$, for which i is a first key generation number, and (b) assigning an apparatus identifier g to the franking device;

transmitting said first franking image key and said first key generation number and said apparatus identifier g from said franking device to a data center remote therefrom;

franking a plurality of mail pieces successively with said franking device by respectively printing successively calculated franking images on said mail pieces, with one franking image on each mail piece;

in said processor at said franking device, calculating a first of said successively calculated franking images using said first franking image key;

in said processor of said franking device, for each franking image in a remainder of said successively calculated franking images, incrementing i by a predetermined amount h and deriving a new franking image key $IDAKey_{i+h}$ therefor, according to a first crypto-algorithm, from an immediately preceding franking image key $IDAKey_{i-h}$ and calculating each franking image in said remainder using the new franking image key $IDAKey_i$ derived therefor;

also in said processor of said franking device, calculating an integrity check code M for each of said successively calculated franking images, using a second crypto-algorithm, based on said franking image key $IDAKey_i$ thereof, the value i thereof, and said apparatus identifier g;

when printing the successively calculated franking images respectively on the plurality of mail pieces, also printing, on each mail piece, said integrity check code m and the value of i for the franking image on that mail piece, and printing the apparatus identifier on each mail piece;

transporting the mail pieces with the respective franking images printed thereon to a mail sorting center in communication with said data center and, at said mail sorting center, scanning the franking image on each mail piece and, in a further processor in communication with said data center, determining a formulated franking image key $IDAKey_i$, using said first crypto-algorithm, from said first franking image key transmitted to said data center and incremented by the value of i scanned from said mail piece and, in said further processor, forming a comparison integrity check code, using said second crypto-algorithm, from said formulated franking image key, said apparatus identifier g, and said key generation number i scanned from said mail piece, and comparing the comparison integrity check code with the integrity check code M scanned from said mail piece;

upon said comparison integrity check code matching said integrity check code M scanned from said mail piece, recording a fee for mailing the mail piece, and associating said fee at said data center with said apparatus identifier g; and at an end of an accounting period, invoicing a sender associated with the franking device identified by the apparatus identifier g for all fees recorded during said accounting period.

2. A method according to claim 1, comprising incrementing or decrementing the key generation number i by a value h=1 with every franking.

3. A method according to claim 1, comprising deriving the next franking image key $IDAKey_{i+1}$ from the current key generation number i and the current franking image key $IDAKey_i$ for a next key generation number i+1 according to the next crypto-algorithm according to the formula:

$$IDAKey_{i+1} \leftarrow \text{hash}\ (i, IDAKey_i).$$

4. A method according to claim 1, comprising using a hash-based message authentication code (HMAC) as the first crypto-algorithm.

5. A method according to claim 4, comprising generating the integrity check code M according to the second crypto-algorithm using a secret cryptographic franking image key $IDAKey_i$ of the sender, the device identifier g of the franking device and its current key generation number i, according to the formula:

$$M \leftarrow \text{HMAC}(IDAKey_i, g \| i).$$

6. A method according to claim 5 comprising evaluating the scanned data in a verification process at the data center of the mail carrier including determining a mathematical relationship of the scanned key generation number i±x to a copy j of the last used key generation number, and calculating a current franking image verification key $IDAKey_{j\pm h}$ that corresponds to the scanned franking image key when the mathematical relationship is equal to a predetermined mathematical relationship J=j+x with x=h·z, and generating the value x of the variation of the copy j of the last used key generation number from the product of every individual step value h with the number z of variations, and rejecting the mail piece and subjecting the scanned data to error management if the mathematical relationship does not correspond to the predetermined mathematical relationship.

7. A method according to claim 6, comprising returning the mail piece to the sender if the mathematical relationship of the scanned key generation number i±x to the copy j of the last used key generation number does not correspond to the predetermined mathematical relationship, and if the sender of the mail piece has been notified and has agreed to a return.

8. A method according to claim 6, comprising delivering the mail piece to the recipient if the mathematical relationship of the scanned key generation number i±x to the copy j of the last used key generation number does not correspond to the predetermined mathematical relationship, and if the recipient of the mail piece has been notified and has agreed to a delivery.

9. A method according to claim 4, comprising generating the integrity check code M according to the second crypto-algorithm ensues using a secret cryptographic franking image key $IDAKey_i$ of the sender, the device identifier g of the franking device and its current key generation number i, according to the formula:

$$M \leftarrow \text{HMAC}(IDAKey_i, f(g, i, IDAKey_i)).$$

10. A method according to claim 9, comprising generating the integrity check code M according to the second crypto-algorithm ensues using a secret cryptographic franking image key $IDAKey_1$ of the sender, the device identifier g of the franking device and its current key generation number I, according to the formula:

$$M \leftarrow \text{HMAC}(IDAKey_i, f(g, i, IDAKey_i)).$$

11. A method according to claim 10, comprising returning the mail piece to the sender if the mathematical relationship of the scanned key generation number i±x to the copy j of the last used key generation number does not correspond to the predetermined mathematical relationship, and if the sender of the mail piece has been notified and has agreed to a return.

12. A method according to claim 10, comprising delivering the mail piece to the recipient if the mathematical relationship of the scanned key generation number i±x to the copy j of the last used key generation number does not correspond to the predetermined mathematical relationship, and if the recipient of the mail piece has been notified and has agreed to a delivery.

13. A method according to claim 1, comprising:

additionally processing the data representing the franking image scanned at the data center in a routine including decoding of the scanned data, a determining of the respective sender, determining the respective postage fee, implementing a security verification of every franking image, and centralized billing the postage fee to an account of the sender, and transporting and delivering properly franked mail pieces to the recipient or rejecting mail pieces in the mail sorting center if the additional processing of the scanned data in the routine is not possible;

determining the respective sender by implementing a search for the device identifier g of the franking device in a database of the mail sorting center or data center, and for an associated, stored copy j of the last used key generation number for which an associated stored franking image key exists;

in the security check of each franking image, determining a mathematical relationship of the scanned key generation number i±x to the copy j of the last used key generation number as well as a cryptographic verification of the integrity check code M, and generating a franking image verification key $IDAKey_J$ that corresponds to the current following franking image key $IDAKey_{i\pm x}$ of the franking device according to the first crypto-algorithm, by implementing the integrity check z times corresponding to the determination of the mathematical relationship, and using the franking image verification key $IDAKey_J$ together with the copy j of the currently used key generation number i±x and with the device identifier g to form a comparison integrity check code Mref according to the second crypto-algorithm.

14. A method according to claim 1, comprising securing the security of the device identifier with at least one password input.

15. A method according to claim 14, comprising before calculating the franking image, entering the password and the device identifier and querying the authenticity thereof when a predetermined time period for storage of the internal encryption key has expired.

16. A method according to claim 14, comprising changing the existing password as needed before calculating the franking image with the current password, and entering the current password and querying the device identifier and its authenticity before a change of the existing password.

17. A method according to claim 14, comprising securing the apparatus identifier by a combination of:

a) entering the password via a medium keyboard, selected from the group consisting of a RFID identification, a magnetic card, a chip card, a mobile device connected by a personal network to the franking device side;

b) authenticating the device identifier in every franking imprint at the mail carrier in order to exclude use of incorrect device identifiers;

c) one-time authenticating the device identifier in each franking imprint at the mail carrier side in order to exclude reuse of copied authentications of incorrect device identifiers;

d) securing the communication connection, at least to the operator data center, by encryption; and e) administering separate user accounts via an operating system of a personal computer with use of multi-user franking devices.

18. A method according to claim 17, comprising transmitting a generated first franking image key via a secure communication connection to the data center of an operator and subsequently to the data center of the mail carrier during the initialization of the franking device.

* * * * *